US005365741A

United States Patent [19]

Roberts et al.

[11] Patent Number: 5,365,741

[45] Date of Patent: Nov. 22, 1994

[54] CRYOGENIC RECTIFICATION SYSTEM WITH LIQUID OXYGEN BOILER

[75] Inventors: Mark J. Roberts, Grand Island; Robert A. Beddome, Tonawanda; Dante P. Bonaquist, Grand Island, all of N.Y.

[73] Assignee: Praxair Technology, Inc., Danbury, Conn.

[21] Appl. No.: 60,136

[22] Filed: May 13, 1993

[51] Int. Cl.[5] ..... F25J 3/00

[52] U.S. Cl. ..... 62/38; 62/41

[58] Field of Search ..... 62/24, 41, 38

[56] References Cited

U.S. PATENT DOCUMENTS

| | | | |
|---|---|---|---|
| 4,464,188 | 8/1984 | Agrawal | 62/13 |
| 4,560,398 | 12/1985 | Beddome et al. | 62/29 |
| 4,670,031 | 6/1987 | Erickson | 62/22 |
| 4,746,343 | 5/1988 | Ishizu et al. | 62/38 |
| 4,769,055 | 9/1988 | Erickson | 62/22 |
| 4,777,803 | 10/1988 | Erickson | 62/22 |
| 4,817,393 | 4/1989 | Erickson | 62/22 |
| 4,932,212 | 6/1990 | Rohde | 62/22 |
| 4,936,099 | 6/1990 | Woodward et al. | 62/24 |
| 4,994,098 | 2/1991 | Agrawal et al. | 62/22 |
| 5,037,462 | 8/1991 | Schweigert | 62/24 |
| 5,098,456 | 3/1992 | Dray et al. | 62/24 |
| 5,108,476 | 4/1992 | Dray et al. | 62/24 |
| 5,114,452 | 5/1992 | Dray | 62/24 |
| 5,148,680 | 9/1992 | Dray | 62/24 |
| 5,157,926 | 10/1992 | Guilleminot | 62/24 |

*Primary Examiner*—Ronald C. Capossela
*Attorney, Agent, or Firm*—Stanley Ktorides

[57] ABSTRACT

A cryogenic rectification system wherein compressed feed is further compressed in a compressor coupled to a turboexpander and turboexpanded through the turboexpander to drive the compressor, and a portion of the feed which does not undergo turboexpansion is condensed against liquid oxygen in a product boiler.

10 Claims, 2 Drawing Sheets

CRYOGENIC RECTIFICATION SYSTEM WITH LIQUID OXYGEN BOILER

TECHNICAL FIELD

This invention relates generally to cryogenic rectification and more particularly to cryogenic rectification wherein liquid oxygen is vaporized to condense feed.

BACKGROUND ART

Oxygen is produced commercially in large quantities by the cryogenic rectification of feed air, generally employing the well known double column system, wherein product oxygen is taken from the lower pressure column. At times it may be desirable to produce oxygen at a pressure which exceeds its pressure when taken from the lower pressure column. In such instances, gaseous oxygen may be compressed to the desired pressure. However, it is generally preferable, both for safety and for operating cost purposes, to remove oxygen as liquid from the lower pressure column, pump it to a higher pressure, and then vaporize the pressurized liquid oxygen to produce the desired elevated pressure product oxygen gas.

Cryogenic rectification requires refrigeration in order to operate. The requisite refrigeration is increased when oxygen is withdrawn from the column as liquid and pumped prior to vaporization because the pump work is added to the system. Refrigeration may be provided to the cryogenic process by the turboexpansion of a stream fed into the rectification column system. However, the compression of a stream for the turboexpansion consumes a significant amount of energy.

Accordingly, it is an object of this invention to provide a cryogenic rectification system wherein liquid oxygen is removed from the column system for boiling and wherein process refrigeration is provided by turboexpansion of a feed stream, which has improved operating efficiency over conventional oxygen product boiler cycles.

SUMMARY OF THE INVENTION

The above and other objects which will become apparent to those skilled in the art upon a reading of this disclosure are attained by the present invention, one aspect of which is:

A method for producing oxygen by cryogenic rectification comprising:

(A) compressing feed air to a first pressure;

(B) further compressing at least 55 percent of the compressed feed air to a second pressure by passing it through a compressor coupled to a turboexpander;

(C) turboexpanding at least some of the further compressed feed air by passing it through said turboexpander but maintaining at least some feed air from undergoing said turboexpansion;

(D) introducing turboexpanded feed air into the higher pressure column of a double column cryogenic rectification plant;

(E) condensing at least some of the feed air which is not turboexpanded;

(F) introducing condensed feed air into the higher pressure column; and (G) withdrawing liquid oxygen from the cryogenic rectification plant, vaporizing liquid oxygen by indirect heat exchange with said condensing feed air, and recovering resulting oxygen as product.

Another aspect of the invention is:

Apparatus for producing oxygen by cryogenic rectification comprising:

(A) a first compressor, a second compressor and a turboexpander coupled to the second compressor;

(B) means for passing feed to the first compressor and from the first compressor to the second compressor;

(C) a double column cryogenic rectification plant comprising a higher pressure column;

(D) means for passing feed from the second compressor to the turboexpander and from the turboexpander into the higher pressure column;

(E) a product boiler, means for passing feed to the product boiler and from the product boiler into the higher pressure column;

(F) means for passing fluid from the cryogenic rectification plant to the product boiler; and (G) means for recovering product fluid from the product boiler.

As used herein, the term "feed air" means a mixture comprising primarily nitrogen, oxygen and argon, such as air.

As used herein, the terms "turboexpansion" and "turboexpander" mean respectively method and apparatus for the flow of high pressure gas through a turbine to reduce the pressure and the temperature of the gas thereby generating refrigeration.

As used herein, the term "column" means a distillation or fractionation column or zone, i.e. a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineers' Handbook fifth edition, edited by R. H. Perry and C. H. Chilton, McGraw-Hill Book Company, New York, Section 13, *The Continuous Distillation Process.* The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin.

As used herein, the term "indirect heat exchange" means the bringing of two fluid streams into heat exchange relation without any physical contact or intermixing of the fluids with each other.

As used herein, the term "argon column" means a column which processes a feed comprising argon and produces a product having an argon concentration which exceeds that of the feed and which may include a heat exchanger or a top condenser in its upper portion. As used herein, the term "liquid oxygen" means a liquid having an oxygen concentration of at least 95 mole percent.

As used herein, the term "coupled" means mechanically connected so as to transfer work directly from one device to another without any intermediate gears. The coupling may be by means of a single rotating shaft connecting the two devices.

DETAILED DESCRIPTION

The invention employs a compressor coupled to a turboexpander and passes fluid compressed by the compressor to the turboexpander for turboexpansion to generate refrigeration for introduction into the cryogenic rectification plant. The fluid passing through the turboexpander drives the compressor by virtue of the coupling of these two pieces of equipment thus eliminating the need for a generator to capture energy produced by the turboexpansion and improving the operating efficiency of the compressor. A portion of the feed which has not been turboexpanded is condensed to boil liquid oxygen. Thus, the condensing feed is uncoupled from the remaining feed enabling this fluid to be compressed independently to the pressure level required for the product boiler thus allowing oxygen product pressure requirements to be independent of plant refrigeration requirements.

Figure 1:
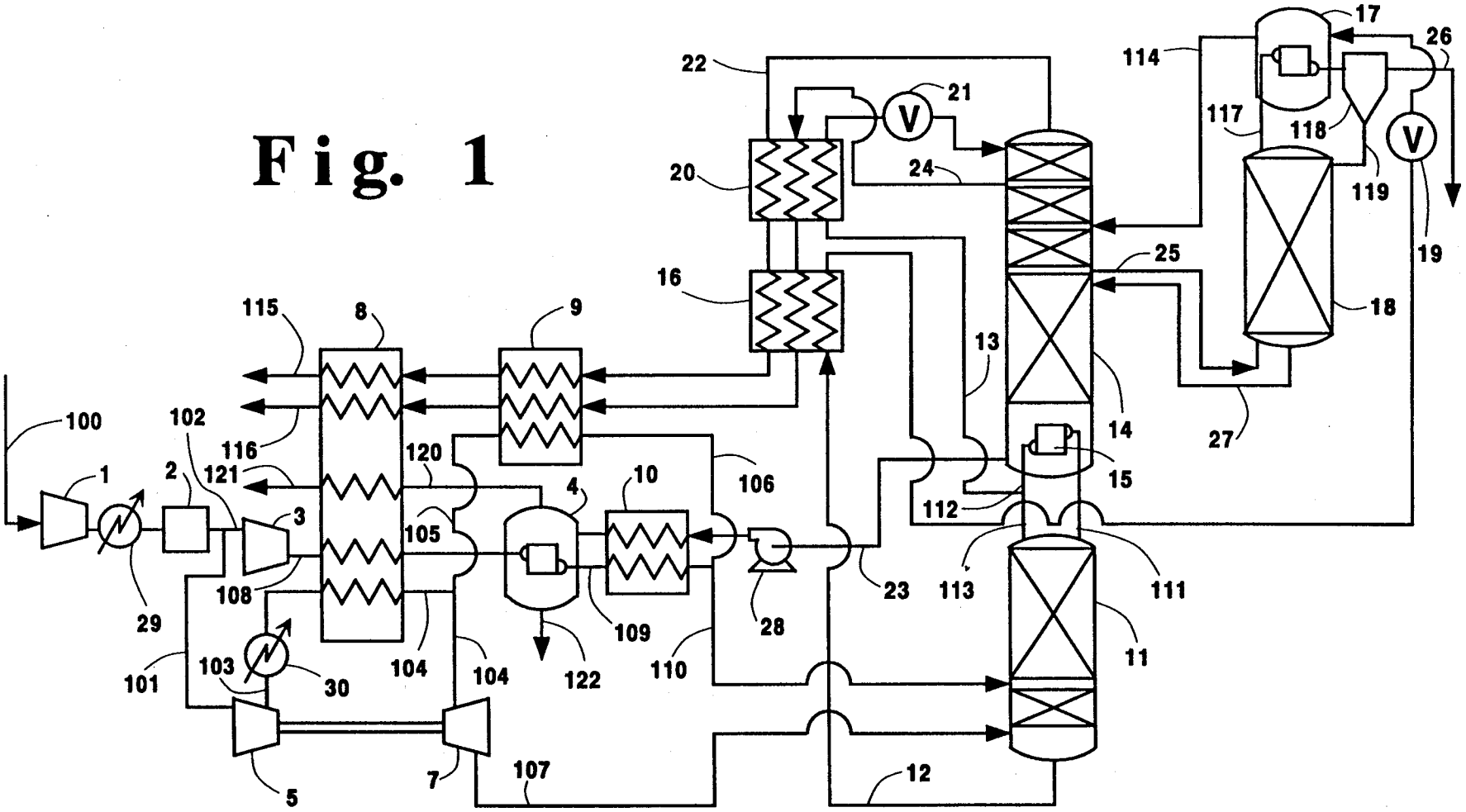
FIG. 1 is a schematic representation of one preferred embodiment of the invention wherein only a portion of the compressed feed is further compressed by the compressor coupled to the turboexpander.

The invention will be described in detail with reference to the Drawings. Referring now to FIG. 1, feed such as feed air 100, is compressed by passage through first or base load compressor 1 to a first pressure generally within the range of from 70 to 150 pounds per square inch absolute (psia). The compressed feed air is cooled through cooler 29 to remove heat of compression and cleaned of high boiling impurities such as carbon dioxide and water vapor by passage through adsorber 2. The feed air is then divided into a first portion 101 and a second portion 102. Portion 101 comprises at least 55 percent and preferably comprises from 65 to 80 percent of the compressed feed air. Portion 101 is further compressed to a second pressure, which exceeds the first pressure and is generally within the range of from 80 to 170 psia, by passage through second compressor 5 which is coupled to turboexpander 7. The further compressed feed air 103 is passed through cooler 30 to remove heat of compression and then cooled by indirect heat exchange with return streams by passage through main heat exchanger 8. Resulting cooled stream 104 is passed to turboexpander 7. A small portion 105 of cooled stream 104 may be liquefied by passage through heat exchanger 9 by indirect heat exchange with return streams. Resulting liquefied stream 106 is then passed into column 11 which is the higher pressure column of a double column cryogenic rectification plant which also comprises lower pressure column 14.

Cooled further compressed stream 104 is turboexpanded by passage through turboexpander 7 thus generating refrigeration and also driving compressor 5. Turboexpanded stream 107 is introduced into higher pressure column 11 which is operating at a pressure generally within the range of from 65 to 100 psia.

Feed stream 102, which does not pass through turboexpander 7, preferably is compressed to a third pressure by passage through compressor 3. Generally, the third pressure will differ from the second pressure and will be within the range of from 100 to 1400 psia. Resulting stream 108 is cooled by passage through main heat exchanger 8 and is passed to product boiler 4 wherein it is condensed by indirect heat exchange with boiling liquid oxygen as will be more fully described later. Condensed feed air 109 is subcooled by passage through heat exchanger 10 by indirect heat exchange with liquid oxygen and is passed into column 11 preferably at a point above the point where stream 107 is passed into column 11. Generally, this point will be at least 2 equilibrium stages above the stream 107 introduction point. If desired, stream 109 may be combined with stream 106 and this combined stream 110, as illustrated in FIG. 1, may be introduced as described into column 11.

Within column 11, the feeds are separated by cryogenic rectification into nitrogen-enriched top vapor and oxygen-enriched bottom liquid. The embodiment illustrated in FIG. 1 also includes a third column which in this case is an argon column for the production of crude argon. Nitrogen-enriched top vapor 111 is passed into main condenser 15 wherein it is condensed against reboiling column 14 bottoms. Resulting condensed fluid 112 is passed in stream 113 as reflux into column 11, and in stream 13 through heat exchanger 20 and valve 21 into column 14 as reflux. Oxygen-enriched liquid is passed in stream 12 from column 11 through heat exchanger 16, wherein it is subcooled by indirect heat exchange with return streams, and through valve 19 into top condenser 17 of argon column 18. In top condenser 17, the oxygen-enriched liquid is partially vaporized and the resulting vapor and liquid (shown for convenience in FIG. 1 as one stream 114) is passed into column 14.

Column 14 is operating at a pressure less than that of column 11 and generally within the range of from 16 to 30 psia. Within column 14 the fluids fed into column 14 are separated by cryogenic rectification into nitrogen-rich vapor and oxygen-rich liquid, i.e. liquid oxygen. Nitrogen-rich vapor is withdrawn from column 14 in line 22, warmed by passage through heat exchangers 20, 16, 9 and 8 and, if desired, recovered as product nitrogen 115 having a nitrogen concentration of a least 98 mole percent. For product purity control purposes, a waste stream 24 is withdrawn from column 14 at a point below the point where stream 22 is withdrawn, passed through heat exchangers 20, 16, 9 and 8 and removed from the system as stream 116.

An argon containing fluid is passed from column 14 to argon column 18 in line 25, and is separated by cryogenic rectification in argon column 18 into argon-richer vapor and oxygen-richer liquid. The oxygen-richer liquid is returned to column 14 by line 27. Argon-richer vapor is passed in line 117 into top condenser 17 wherein it is partially condensed by indirect heat exchange with oxygen-enriched fluid. Resulting argon-richer fluid is passed into phase separator 118 and liquid 119 from phase separator 118 is passed into column 18 as reflux. Vapor 26 from phase separator 118 is recovered as product crude argon having an argon concentration of at least 90 mole percent.

Liquid oxygen is withdrawn from column 14 in line 23 and preferably is pumped to a higher pressure by passage through liquid pump 28. The liquid oxygen is then warmed by passage through heat exchanger 10 and then passed into product boiler 4 wherein it is vaporized by indirect heat exchange with condensing feed air. Resulting vaporized oxygen 120 is warmed by passage through main heat exchanger 8 and recovered as product oxygen gas 121 having an oxygen concentration of at least 95 mole percent. The pressure of the product oxygen gas will vary, depending upon whether and how liquid pump 28 is employed, from the pressure prevailing at the column 14 withdrawal point to a pressure of about 1200 psia. If desired, some liquid oxygen may be recovered from product boiler 4 in line 122.

Figure 2:
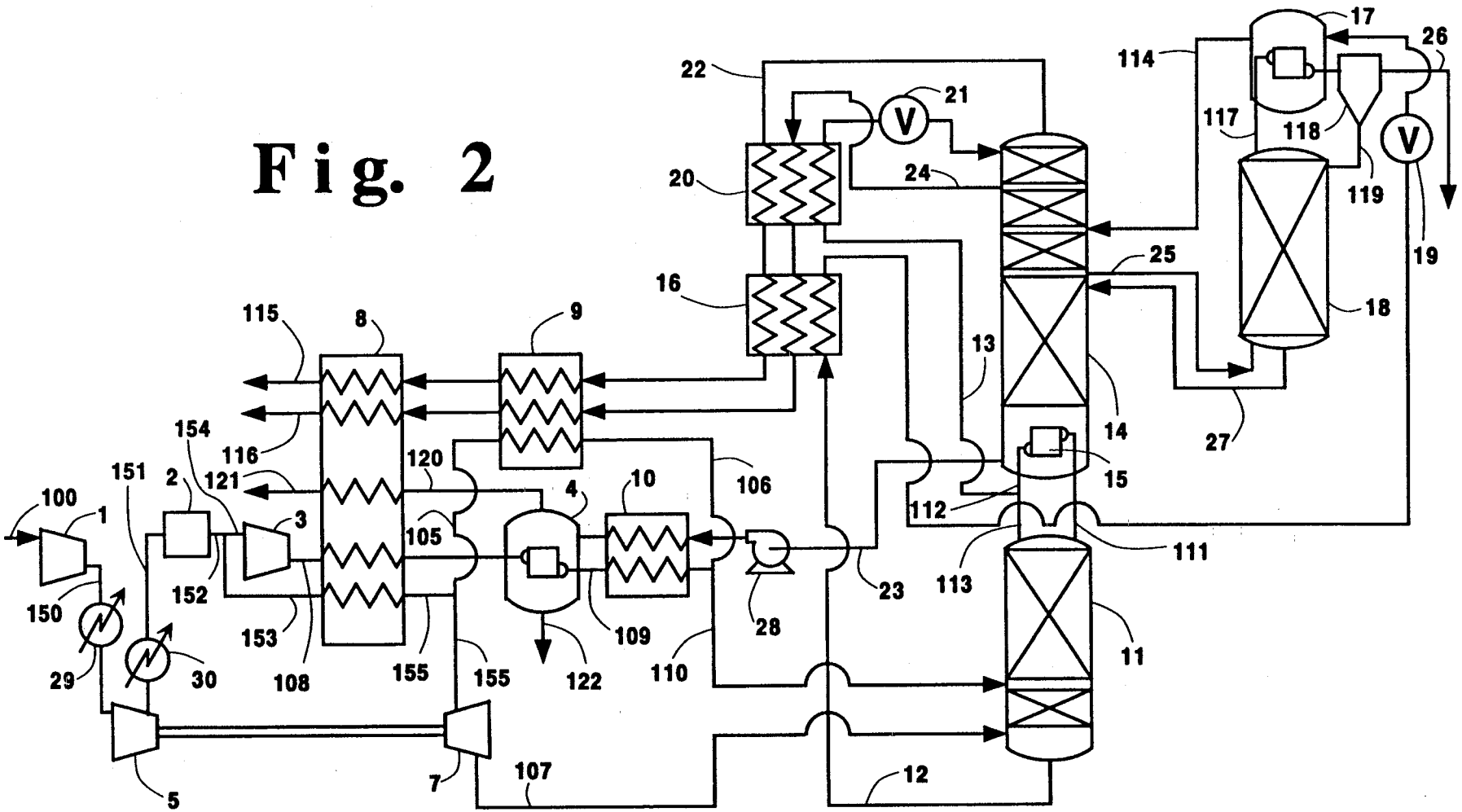
FIG. 2 is a schematic representation of another preferred embodiment of the invention wherein all of the compressed feed is further compressed by the compressor coupled to the turboexpander.

FIG. 2 illustrates one preferred embodiment of the invention wherein all of the feed air which is compressed to the first pressure is further compressed to the second pressure. The numerals in FIG. 2 correspond to those of FIG. 1 for the common elements and these common elements will not be described again in detail.

Referring now to FIG. 2, the entire feed 150 which has been compressed through first compressor 1 to the first pressure is further compressed to the second pressure by passage through second compressor 5. Resulting further compressed feed stream 151 is cleaned of high boiling impurities by passage through adsorber 2 and resulting stream 152 is divided into two portions 153 and 154. Portion 153 comprises from about 65 to 80 percent of the feed and is cooled by passage through main heat exchanger 8 prior to being passed as stream 155 through turboexpander 7. A portion 105 of stream 155 may be liquefied as was the case with the embodiment illustrated in FIG. 1. Feed stream 154, which does not pass through turboexpander 7, is preferably compressed to the third pressure by passage through third compressor 3, cooled by passage through main heat exchanger 8 and passed into product boiler 4 wherein it is condensed by indirect heat exchange with boiling liquid oxygen. The other elements of the embodiment illustrated in FIG. 2 are substantially the same as those illustrated in FIG. 1.

The following example is provided for illustrative purposes and is not intended to be limiting. The example reports a computer simulation of the invention employing the embodiment of the invention illustrated in FIG. 1 and employing air as the feed. The numerals correspond to those of FIG. 1, Air at atmospheric temperature and pressure is compressed by passage through first compressor 1 to a first pressure of 115 psia. The air is then cooled to 299 Kelvin in cooler 29. After purification and water removal in adsorber 2, the air temperature is 289 Kelvin. A portion 102, equalling 24 percent of the air is compressed in third compressor 3 to a third pressure of 346 psia. The remaining 76 percent of the air in line 101 is compressed in second compressor 5 to a second pressure of 127 psia. Stream 103 is then cooled in cooler 30 to a temperature of 290 Kelvin and then further cooled in heat exchanger 8 to 111 Kelvin by heat exchange with cold returning streams. A small portion 105 of this stream equalling 3.5 percent of the air flow is liquefied in heat exchanger 9. The remaining portion is turboexpanded to a pressure of 78 psia by passage through turboexpander 7 and introduced into the bottom of higher pressure column 11. Compressor 5 is mechanically coupled to turboexpander 7, thus providing the work of compression.

After exiting compressor 3, the stream 108 is cooled in main heat exchanger 8 to 158 Kelvin and is then condensed in product boiler 4, by heat exchange with liquid oxygen boiling at a pressure of 150 psia. 3.0 percent of the liquid oxygen is withdrawn as liquid product 122. Stream 109 is then subcooled in heat exchanger 10 by heat exchange with warming liquid oxygen, before being combined with stream 106 and introduced into higher pressure column at an intermediate point.

Higher pressure column 11 is operated at a pressure of 78 psia. The pressure at the top of column 14 is 15.2 psia.

The purity of liquid oxygen stream 23 is 99.6 percent oxygen on a molar basis. Nitrogen product stream 22 contains 99.98 mole percent nitrogen and has a flowrate equal to 20 percent of the air flow. The composition of the argon product stream 26 is 98.5 mole percent argon.

Liquid oxygen stream 23 is pumped in liquid pump 25 to a pressure of 150 psia before being introduced into heat exchanger 10 and then into product boiler 4.

The example described above represents a very advantageous turboexpander-compressor combination because high efficiencies can be achieved for both the turboexpander and the booster compressor while operating them at the same speed, without gearing.

For these process conditions, radial turboexpanders and radial compressors are most often employed. For these machines, the design procedure is to choose the operating speed such that optimum efficiency is obtained. The optimum speed is dependent on the particular pressure ratio and flowrate required of the application. Use is made of a dimensionless parameter $n_s$, or specific speed. This parameter is proportional to the rotational speed in RPM. Optimal efficiency for a radial turbine occurs at a value of $n_s$ of about 0.5. Similarly for a radial compressor, the optimal efficiency occurs at about 0.95. In the example described above, a speed of 5800 RPM for both the turbine and the booster results in values on $n_s$ of 0.48 and 0.92 for the turbine and the compressor, respectively. These values will give maximum efficiencies for both wheels. It is thus possible to obtain very high efficiencies for both the turbine and the compressor without gearing by properly choosing the stream to be compressed.

The choice of the stream to be compressed is important. It is not effective to simply combine the turboexpander on a shaft with any booster compressor. Rather, this combination produces an effective match only when the major fraction of the feed air or the total feed air is employed for further compression. It has the advantage of uncoupling the minor feed air stream associated with the product boiler which allows that stream to be compressed independently to the pressure level required for the product boiler. This allows the oxygen product pressure level to be independent of any plant refrigeration requirements.

Further, the arrangement has design flexibility relative to the amount of turbine refrigeration produced by the arrangement. If the required plant refrigeration is increased, for example to produce liquid products, the turbine work is increased, which increases the booster compressor energy available and the resultant air feed pressure level to the turbine. The shaft work balances and corresponding air feed pressure levels are self-compensating as plant refrigeration requirements change.

Although the invention has been described in detail with reference to certain preferred embodiments, those skilled in the art will recognize that there are other embodiments of the invention within the spirit and the scope of the claims.

We claim:

1. A method for producing oxygen by cryogenic rectification comprising:

(A) compressing feed air to a first pressure, (B) further compressing at least 55 percent of the compressed feed air to a second pressure by passing it through a compressor coupled to a turboexpander;

(C) turboexpanding at least some of the further compressed feed air by passing it through said turboexpander but maintaining at least some feed air from undergoing said turboexpansion;

(D) introducing turboexpanded feed air into the higher pressure column of a double column cryogenic rectification plant;

(E) condensing at least some of the feed air which is not turboexpanded;

(F) introducing condensed feed air into the higher pressure column; and (G) withdrawing liquid oxygen from the cryogenic rectification plant, vaporizing liquid oxygen by indirect heat exchange with said condensing feed air, and recovering resulting oxygen gas as product.

2. The method of claim 1 wherein all of the compressed feed air is further compressed to the second pressure by passing it through the compressor coupled to the turboexpander.

3. The method of claim 1 further comprising compressing feed air to a third pressure prior to the condensation by indirect heat exchange with vaporizing liquid oxygen.

4. The method of claim 1 wherein the liquid oxygen is pumped to a higher pressure after withdrawal from the cryogenic rectification plant and prior to vaporization.

5. The method of claim 1 further comprising recovering a nitrogen-rich fluid from the double column cryogenic rectification plant.

6. The method of claim 1 further comprising passing an argon-containing fluid from the double column cryogenic rectification plant into an argon column and recovering an argon-richer fluid from the argon column.

7. Apparatus for producing oxygen by cryogenic rectification comprising:

(A) a first compressor, a second compressor and a turboexpander coupled to the second compressor;

(B) means for passing feed to the first compressor and from the first compressor to the second compressor;

(C) a double column cryogenic rectification. plant comprising a higher pressure column;

(D) means for passing feed from the second compressor to the turboexpander and from the turboexpander into the higher pressure column;

(E) a product boiler, means for passing feed to the product boiler and from the product boiler into the higher pressure column;

(F) means for passing fluid from the cryogenic rectification plant to the product boiler; and (G) means for recovering product gas from the product boiler.

8. The apparatus of claim 7 further comprising a third compressor for compressing feed prior to passing the feed to the product boiler.

9. The apparatus of claim 7 wherein the means for passing fluid from the cryogenic rectification plant to the product boiler comprises a liquid pump.

10. The apparatus of claim 7 further comprising a third column, means for passing fluid from the cryogenic rectification plant to the third column and means for recovering fluid from the third column.

* * * * *